US011174599B2

(12) United States Patent
Kim et al.

(10) Patent No.: US 11,174,599 B2
(45) Date of Patent: Nov. 16, 2021

(54) TEXTILE-REINFORCED CONCRETE ROAD PAVING APPARATUS AND METHOD OF REPAIRING CONCRETE ROAD PAVEMENT USING THE SAME

(71) Applicant: KOREA INSTITUTE OF CIVIL ENGINEERING AND BUILDING TECHNOLOGY, Gyeonggi-Do (KR)

(72) Inventors: Hyeong Yeol Kim, Gyeonggi-do (KR); Jeong Hee Nam, Seoul (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 67 days.

(21) Appl. No.: 16/853,694

(22) Filed: Apr. 20, 2020

(65) Prior Publication Data

US 2021/0148062 A1 May 20, 2021

(30) Foreign Application Priority Data

Nov. 15, 2019 (KR) ..... 10-2019-0147153

(51) Int. Cl.

| | |
|---|---|
| ***E01C 11/00*** | (2006.01) |
| ***E01C 11/18*** | (2006.01) |
| ***E01C 19/30*** | (2006.01) |
| ***E01C 23/06*** | (2006.01) |

(52) U.S. Cl.

CPC ..... *E01C 11/18* (2013.01); *E01C 19/30* (2013.01); *E01C 23/06* (2013.01)

(58) Field of Classification Search

CPC ..... E01C 11/18; E01C 19/30; E01C 23/06
USPC ..... 404/72–75, 90–92, 100–102
See application file for complete search history.

(56) References Cited

U.S. PATENT DOCUMENTS

| | | | | |
|---|---|---|---|---|
| 4,066,723 | A * | 1/1978 | King | E01C 7/14 264/211.11 |
| 4,270,801 | A | 6/1981 | Swisher, Jr. et al. | |
| 4,309,126 | A * | 1/1982 | Pfaff | E04G 23/08 241/271 |

(Continued)

FOREIGN PATENT DOCUMENTS

| | | |
|---|---|---|
| KR | 20070082396 | 8/2007 |
| KR | 101109685 | 2/2012 |

(Continued)

*Primary Examiner* — Raymond W Addie
(74) *Attorney, Agent, or Firm* — JCIPRNET

(57) ABSTRACT

A textile-reinforced concrete road paving apparatus and a method of repairing concrete road pavement can minimize use of construction equipment by using the textile-reinforced concrete road paving apparatus integrally formed to consecutively cut concrete, dispose a reinforcement material, and construct a repaired cross section so as to reduce a construction period, thereby remarkably reducing construction costs. Further, a textile grid reinforcement material, which is a noncorroding reinforcement material, is applied to form the repaired cross section of the concrete road pavement so as to prevent concrete from being detached due to corrosion. Further, a textile reinforced grid is precisely disposed at a required position, and thus the thicknesses of the primary and secondary concrete pavement are precisely adjusted, and thus construction precision can be increased.

19 Claims, 12 Drawing Sheets

(56) References Cited

U.S. PATENT DOCUMENTS 4,319,856 A * 3/1982 Jeppson ..... E01C 23/14 219/699
4,699,330 A * 10/1987 Barazone ..... E01C 19/522 242/557
4,742,970 A * 5/1988 Barazone ..... E01C 19/522 242/557
4,793,731 A * 12/1988 Gnesa ..... E01C 11/005 156/575
5,000,615 A * 3/1991 Murray ..... E01C 23/065 404/101
5,026,205 A * 6/1991 Gorski ..... E01C 19/025 241/101.73
5,026,206 A * 6/1991 O'Connor ..... E01C 19/025 404/77
5,046,888 A 9/1991 King
5,741,085 A * 4/1998 Wirtgen ..... E01C 23/065 404/75
5,836,715 A * 11/1998 Hendrix ..... B29C 70/222 404/134
5,921,706 A * 7/1999 Manatt ..... E01C 23/065 404/72
7,077,601 B2 * 7/2006 Lloyd ..... E01C 23/065 180/209
7,316,521 B2 * 1/2008 Shiomoto ..... E01C 23/03 156/497
8,079,778 B2 * 12/2011 Colkitt ..... E01C 23/04 404/100
11,035,082 B2 * 6/2021 Straubinger ..... E01C 7/185
2012/0282026 A1 * 11/2012 Atherton ..... E01C 19/4866 404/82

FOREIGN PATENT DOCUMENTS

KR 101909112 10/2018
KR 20190084586 7/2019

* cited by examiner a)

b)

a)

b)

TEXTILE-REINFORCED CONCRETE ROAD PAVING APPARATUS AND METHOD OF REPAIRING CONCRETE ROAD PAVEMENT USING THE SAME

CROSS-REFERENCE TO RELATED APPLICATION

This application claims priority to and the benefit of Korean Patent Application No. 10-2019-0147153, filed on Nov. 15, 2019, the disclosure of which is incorporated herein by reference in its entirety.

BACKGROUND

1. Field of the Invention

The present invention relates to a textile-reinforced concrete road paving apparatus, and more specifically, to a textile-reinforced concrete road paving apparatus, which removes a damaged cross section of degraded concrete pavement and constructs a repaired cross section with textile-reinforced concrete (TRC) in a continuous process, and a method of repairing concrete road pavement using the same.

2. Discussion of Related Art

Generally, a concrete slab is constructed on a base, a sub-base course, an intermediate base course, and a surface at a thickness of 30 cm so that concrete pavement is constructed. The concrete pavement is more durable than asphalt pavement that has an average service life of 10 years and has a service life approximately more than twice the service life of the asphalt pavement. However, the concrete pavement may have a disadvantage of a reduced service life caused by damage to a surface due to environmental loads, vehicle loads, and the like.

When cracking, delamination, exfoliation, or the like occurs in a surface of a concrete paved slab, the surface of a concrete paved slab is repaired through a mortar patching method or a partial slab replacement method or is completely replaced.

Specifically, since a mortar patched cross-sectional surface of concrete pavement is easily damaged and delaminated due to water permeating the road and a load of a vehicle, the mortar patching method is not a permanent repair method and is applied only as an emergency repair method.

Further, when overall damage occurs to the concrete slab, full replacement is performed. However, for the full replacement of the concrete pavement, removing the existing pavement, pouring new concrete, and curing the concrete is required, and thus a long time and large costs for replacement are required.

Particularly, in the case of national expressways or general expressways that have a lot of traffic, it may not be possible to completely block traffic during a construction period, and thus huge additional costs occur due to construction of a detour road and the like during the construction period. Further, even when replacement is performed while traffic is partially blocked, huge social costs occur due to vehicle delays and congestion. In the case of full replacement, a large amount of wasted concrete is generated, environment problems may occur, and thus a method of minimizing wasted concrete is required.

Meanwhile, as the related art, an invention titled "Concrete Paving Apparatus for Automatically Supplying Wire Mesh and Method of Paving with Concrete Using the Same" is disclosed in Korean Laid-open Patent Application No. 2019-84586, but the wire mesh manufactured of a steel material may corrode during use. When flat meshes with a predetermined size are installed continuously, the flat meshes should be connected in a lap joint manner to transfer a load in a longitudinal direction of the installation, and thus a problem of low economic efficiency occurs due to unnecessary connection and lap joint.

Meanwhile, according to the related art, when concrete covering construction is performed, a cutting-out process, a concrete paving process, and a curing process are performed independently, and thus a problem occurs of a construction period lengthening.

Further, according to the related art, when a textile reinforcement material is installed on a cross section to be covered, it is inconvenient due to processes in which paving is performed with primary concrete, a grid is installed, and paving is performed with secondary concrete. Further, concrete that needs to be poured continuously is poured in a dividing manner due to construction characteristics, and thus there is a limit due to low construction efficiency and construction quality.

Further, when a reinforcement bar or a wire mesh is applied as a reinforcement material according to the related art, concrete may be detached due to corrosion.

PRIOR ART DOCUMENTS (Patent Document 0001) Korean Laid-open Patent Application No. 2019-84586 (Published on Jul. 17, 2019), Title of invention: "Concrete Paving Apparatus for Automatically Supplying Wire Mesh and Method of Paving Concrete Using the Same"

(Patent Document 0002) Korean Registered Patent No. 10-1909112 (Registered on Oct. 11, 2018), Title of invention: "Apparatus for Spraying Membrane Curing Agent for Paving Concrete Road"

(Patent Document 0003) Korean Laid-open Patent Application No. 2007-82396 (Published on Aug. 21, 2007), Title of invention: "Apparatus of Finishing Poured Concrete.

(Patent Document 0004) Korean Registered Patent No. 10-1109685 (Registered on Jan. 18, 2012), Title of invention: "Apparatus and Method of Crushing Eco-Friendly Concrete Paved Road"

SUMMARY OF THE INVENTION

The present invention is directed to providing a textile-reinforced concrete road paving apparatus which minimizes use of construction equipment by using the textile-reinforced concrete road paving apparatus integrally formed to consecutively cut concrete, dispose a reinforcement material, and construct a repaired cross section, and a method of repairing concrete road pavement using the same.

The present invention is also directed to providing a textile-reinforced concrete road paving apparatus which prevents concrete from being detached due to corrosion by applying a textile grid reinforcement material, which is a noncorroding reinforcement material, to form the repaired cross section of the concrete road pavement, and a method of repairing concrete road pavement using the same.

The present invention is also directed to providing a textile-reinforced concrete road paving apparatus which precisely disposes the textile reinforcement grid at a required position and precisely adjusts the pouring thickness of the primary and secondary concrete, and a method of repairing concrete road pavement using the same.

According to an aspect of the present invention, there is provided a textile-reinforced concrete road paving apparatus which includes a damaged cross section removing unit configured to cut and remove a damaged cross section of concrete road pavement below a front part of a moving working vehicle, a primary concrete paving and flattening unit configured to perform paving with primary concrete using a primary concrete paving tube and a first spreader and flattening the primary concrete, a first vibration press machine configured to simultaneously compact the primary concrete and construct a first repair layer of a repaired cross section to have a required thickness, a textile reinforcement material winding roll on which a textile reinforcement material, which is a noncorroding reinforcement material, is wound and which continuously disposes the textile reinforcement material on the repaired cross section, a secondary concrete paving and flattening unit configured to pave an upper portion of the first repair layer with secondary concrete using a secondary concrete paving tube and a second spreader and flatten the secondary concrete, a second vibration press machine configured to simultaneously compact the secondary concrete and construct a second repair layer to have a required thickness, and a repaired cross section finishing unit configured to finish and cure the repaired cross section below a rear part of the moving working vehicle, wherein the repaired cross section includes the first repair layer, the textile reinforcement material, and the second repair layer, and the textile-reinforced concrete road paving apparatus is configured to consecutively and collectively cut concrete, dispose a reinforcement material, and construct a repaired cross section.

The damaged cross section removing unit may include circular grinders that are mounted on both sides of the front part of the moving working vehicle and form grooves in the damaged cross section of the concrete road pavement, a coal miner-type cutting machine that cuts out and removes the damaged cross section of the concrete road pavement at a predetermined thickness, a vacuum suction device that removes concrete of the damaged and cut cross section, and a water spraying device that sprays water to keep an upper surface of the repaired cross section moist before the construction of the first repair layer.

The coal miner-type cutting machine may cut the damaged cross section to within 5 cm once so that remainder is discharged through vacuum suction.

The primary concrete paving and flattening unit may include the primary concrete paving tube that performs paving with the primary concrete for the construction of the first repair layer, and the first spreader that moves in a direction perpendicular to a traveling direction of a road and evenly flattens the paved primary concrete.

A water spraying tube of the water spraying device may be spaced apart from the primary concrete paving tube so that the sprayed water sufficiently permeates the cross section.

The secondary concrete paving and flattening unit may include the secondary concrete paving tube that performs paving with the secondary concrete for the construction of the second repair layer and the second spreader that moves in a direction perpendicular to the traveling direction of the road and evenly flattens the paved secondary concrete.

The repaired cross section finishing unit may include a plastering knife that moves in a direction perpendicular to the traveling direction of the road and finishes the repaired cross section and a membrane curing solution spraying device that sprays a membrane curing solution so that curing starts immediately after the construction of the repaired cross section.

The moving working vehicle may be self-propelled forward by continuous tracks wherein the continuous tracks are mounted on four edges of the moving working vehicle and include height adjustment devices that adjust a height of the moving working vehicle through vertical movement.

In the moving working vehicle, the heights of the first and second vibration press machines, the textile reinforcement material winding roll, and a plastering knife may be adjusted by a computer so that a required thickness is formed.

The moving working vehicle may include a hydraulic actuator that is controlled by a sensor and a computer to adjust the height of the moving working vehicle and applied pressure.

According to another aspect of the present invention, there is provided a method of repairing concrete road pavement using a textile-reinforced concrete road paving apparatus which includes a) cutting out and removing a damaged cross section of concrete pavement below a front part of a moving working vehicle using the textile-reinforced concrete road paving apparatus, b) performing paving with primary concrete using a primary concrete paving tube and a first spreader and flattening the primary concrete, c) simultaneously compacting the primary concrete using a first vibration press and constructing a first repair layer of a repaired cross section to have a required thickness, d) continuously disposing a textile reinforcement material to the repaired cross section from a textile reinforcement material winding roll, e) performing paving with secondary concrete on the first repair layer using a secondary concrete paving tube and a second spreader and flattening the secondary concrete, f) simultaneously compacting the secondary concrete using a second vibration press machine and constructing a second repair layer to have a required thickness, and g) finishing the repaired cross section and immediately curing the repaired cross section below a rear part of the moving working vehicle, wherein the repaired cross section includes the first repair layer, the textile reinforcement material, and the second repair layer, wherein the textile-reinforced concrete road paving apparatus collectively and consecutively cuts out concrete, disposes a reinforcement material, and finishes a repaired cross section.

Operation a) may include a-1) forming grooves in the damaged cross section using circular grinders, a-2) cutting and removing the damaged cross section at a predetermined thickness using a coal miner-type cutting machine, a-3) removing concrete of the damaged and cut cross section using a vacuum suction device, and a-4) keeping an upper surface of the repaired cross section moist using a water spraying device before the construction of the first repair layer.

Operation b) may include b-1) performing paving with the primary concrete for the construction of the first repair layer using the primary concrete paving tube and b-2) evenly flattening the paved primary concrete using the first spreader that moves in a direction perpendicular to a traveling direction of a road.

Operation e) may include e-1) performing paving with the secondary concrete for the construction of the second repair layer using the secondary concrete paving tube and e-2) evenly flattening the paved secondary concrete using the second spreader that moves in a direction perpendicular to a traveling direction of a road.

Operation g) may include g-1) finishing the repaired cross section using a plastering knife that moves in a direction perpendicular to a traveling direction of a road and g-2) spraying a membrane curing solution using a membrane curing solution spraying device to start curing immediately after the construction.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
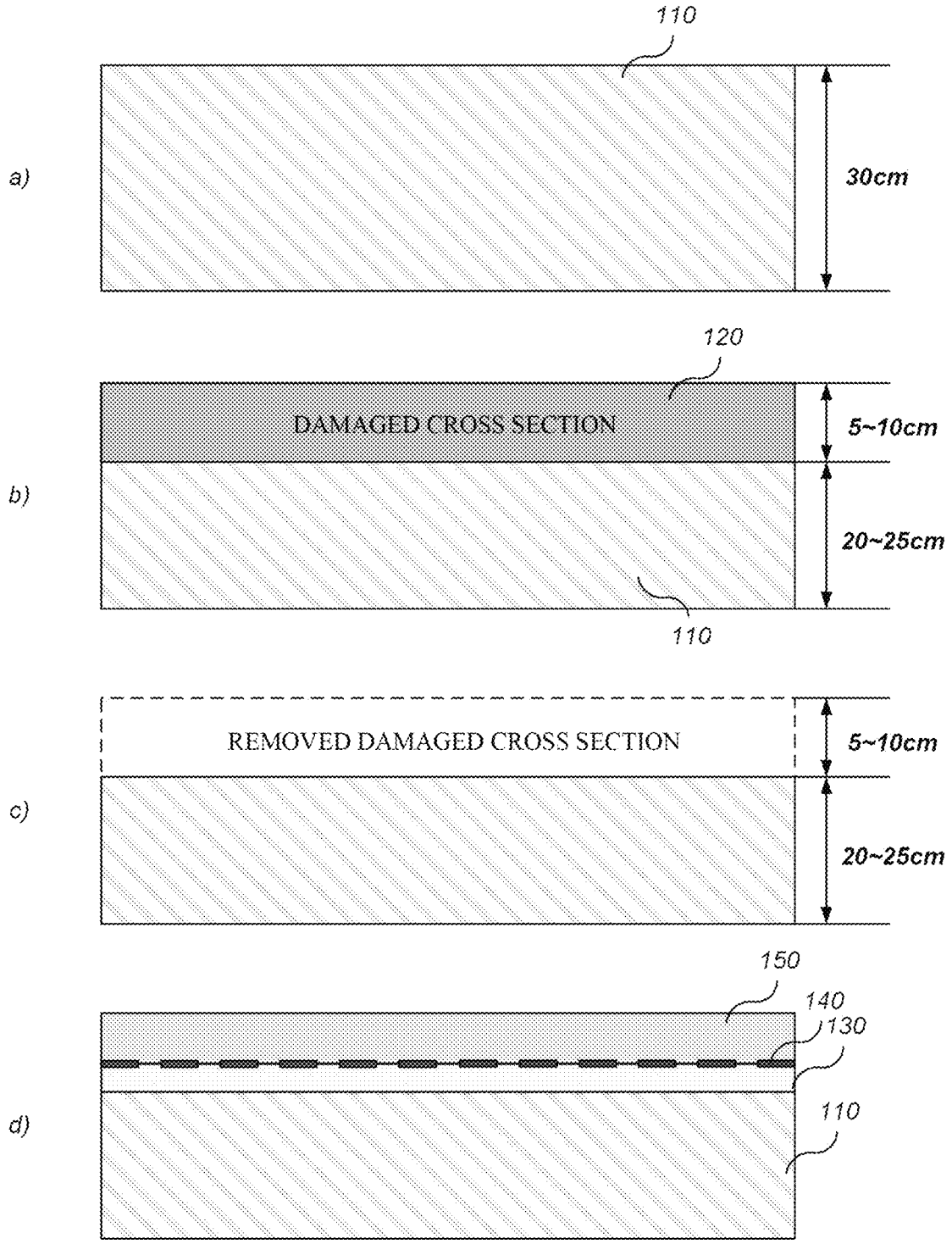
FIG. 1 is a cross-sectional view of a textile-reinforced concrete road pavement to which a textile-reinforced concrete road paving apparatus according to an embodiment of the present invention is applied.

Hereinafter, embodiments that are easily performed by those skilled in the art will be described in detail with reference to the accompanying drawings. However, the embodiments of the present invention may be implemented in several different forms and are not limited to the embodiments described herein. In addition, parts irrelevant to description will be omitted in the drawings to clearly explain the embodiments of the present invention. Similar parts are denoted by similar reference numerals throughout this specification.

Throughout the specification, when a portion "includes" an element, the portion may include the element and another element may be further included therein, unless otherwise described.

Textile-Reinforced Concrete Road Paving Apparatus (200)

Figure 2:
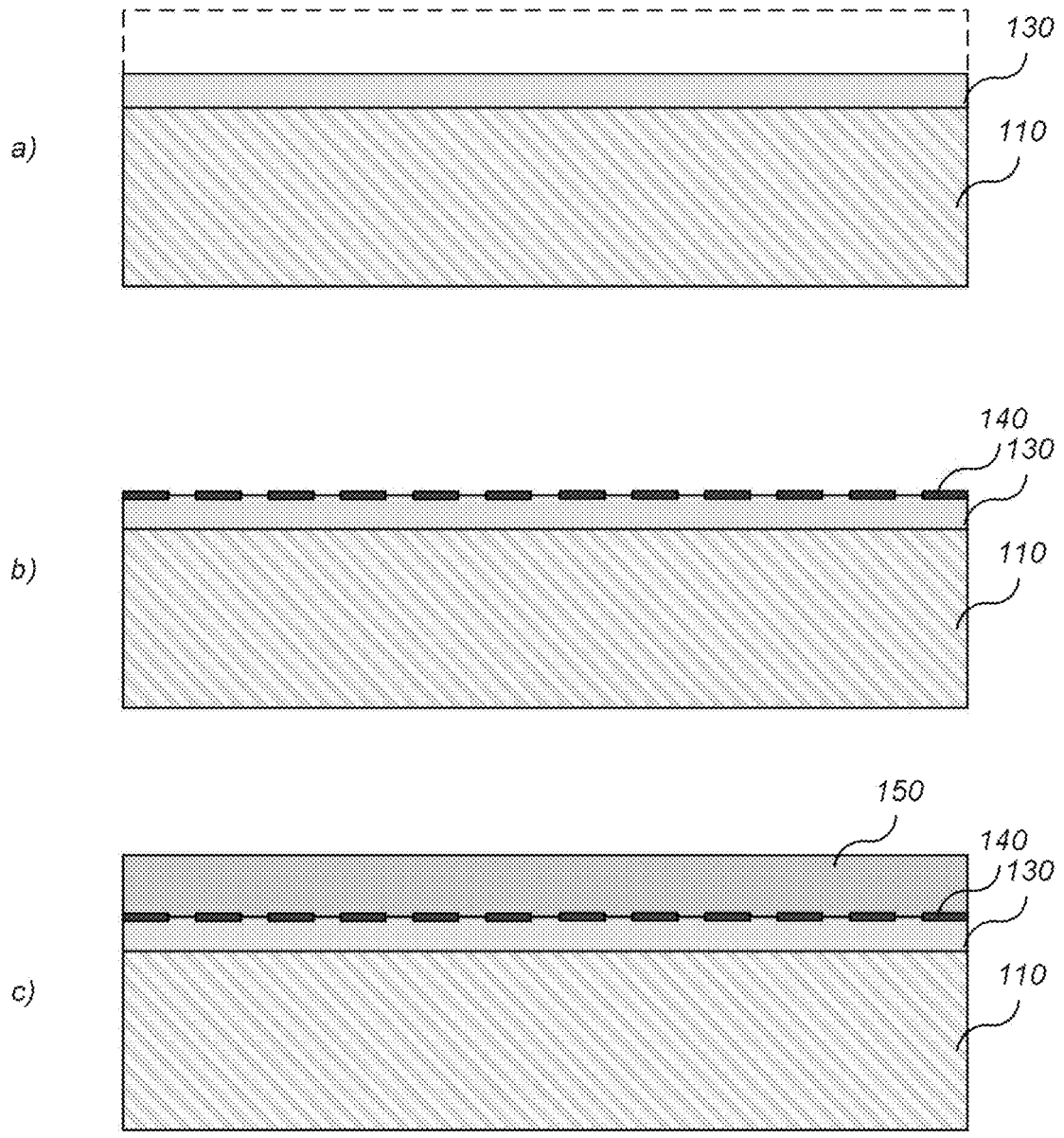
FIG. 2 is a cross-sectional view specifically illustrating a repaired cross section of the textile-reinforced concrete road pavement shown in FIG. 1.

FIG. 1 is a cross-sectional view of a textile-reinforced concrete road pavement to which a textile-reinforced concrete road paving apparatus according to an embodiment of the present invention is applied, and FIG. 2 is a cross-sectional view specifically illustrating a repaired cross section of the textile-reinforced concrete road paving shown in FIG. 1. Hereinafter, it will be described that the repaired cross section is constructed with concrete, however, it will be apparent to those skilled in the art that the repaired cross section is constructed with mortar excluding coarse aggregate according to a thickness of the repaired cross section when needed.

As shown in a) of FIG. 1, a thickness of a concrete slab 110 formed on concrete road pavement is about 30 cm, and generally, even when damage occurs to the concrete slab 110, the damage barely occurs to a lowermost surface. As shown in b) of FIG. 1, the damage is generally concentrated within a depth of about 5 to 10 cm from an uppermost surface of the concrete slab 110.

Therefore, even when damage occurs to the overall concrete slab 110, a method of cutting out the damaged concrete slab 110 of about 5 to 10 cm from the uppermost surface of the concrete slab 110 as shown in c) of FIG. 1 and covering the cut surface with concrete as shown in d) of FIG. 1 is more economical than a method of fully replacing the concrete slab 110. In the case of a textile-reinforced concrete road paving apparatus according to the embodiment of the present invention, a first repair layer 130, a textile grid reinforcement material 140, and a second repair layer 150 are constructed, and a repaired cross section is constructed. In this case, a reinforcement material may be disposed on the covered concrete to suppress cracks due to environment loads and the like.

In this case, when a reinforcement bar or a wire mesh is applied as the reinforcement material, the concrete may be detached due to corrosion, and thus, in the textile-reinforced concrete road paving apparatus according to the embodiment of the present invention, the textile grid reinforcement material 140 is applied as a noncorroding reinforcing material to prevent the concrete from being detached due to corrosion.

Specifically, in the textile-reinforced concrete road paving apparatus according to the embodiment of the present invention, as shown in a) of FIG. 2, the first concrete is poured on the concrete slab 110, from an uppermost surface of which about 5 to 10 cm is cut, to form a first repair layer 130, the textile grid reinforcement material 140 is disposed on the first repair layer 130, and the first concrete is poured on the first repair layer 130 to form the second repair layer 150, and thus the repaired cross section is constructed.

Figure 3:
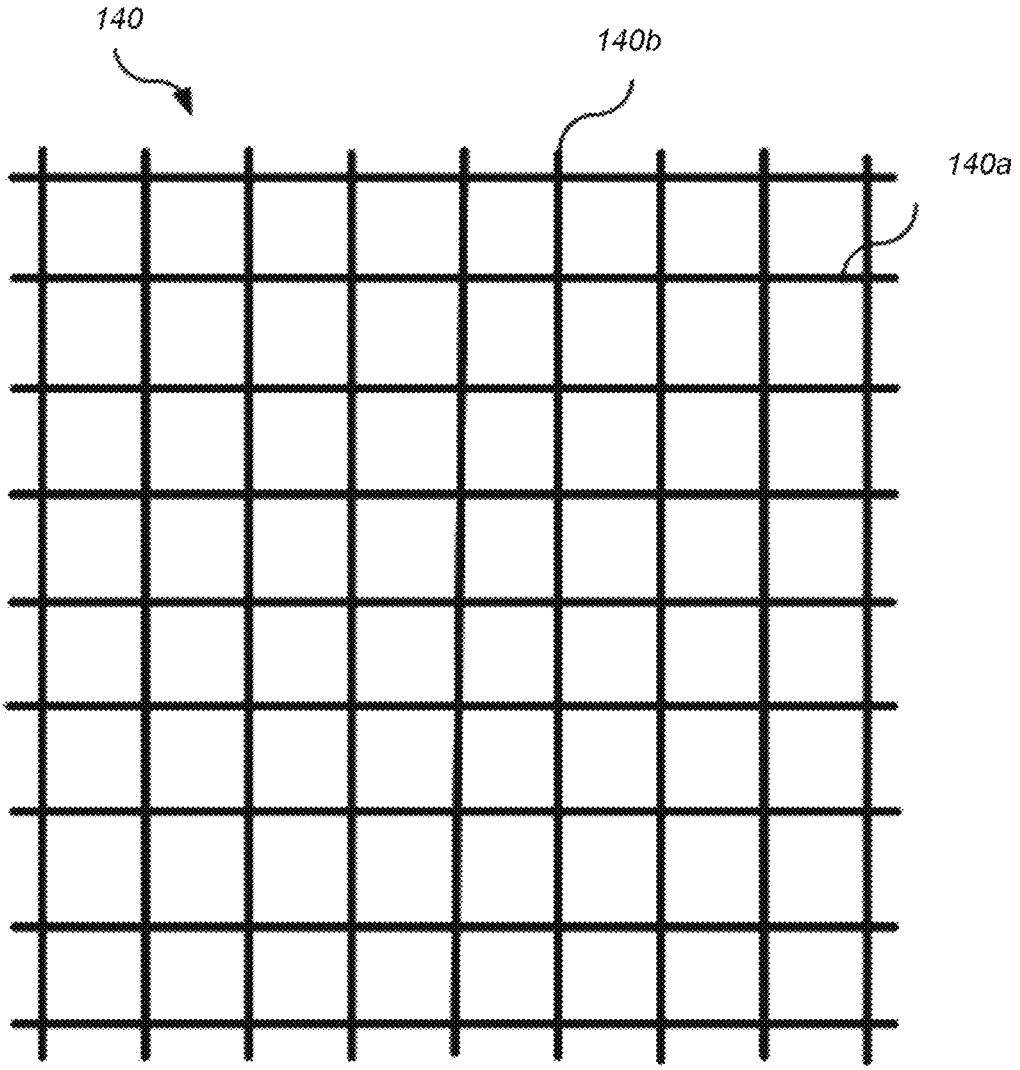
FIG. 3 is a view illustrating a textile reinforcement material in the textile-reinforced concrete road paving apparatus according to the embodiment of the present invention.
Figure 4:
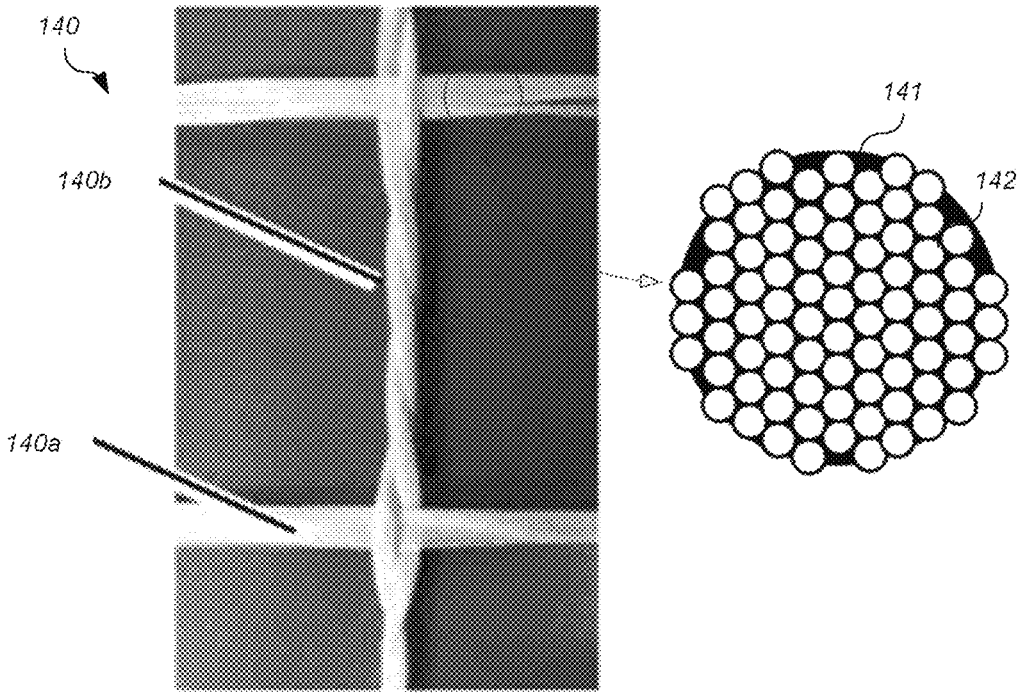
FIG. 4 is a view illustrating the textile grid reinforcement material manufactured through a weaving method.
Figure 4:
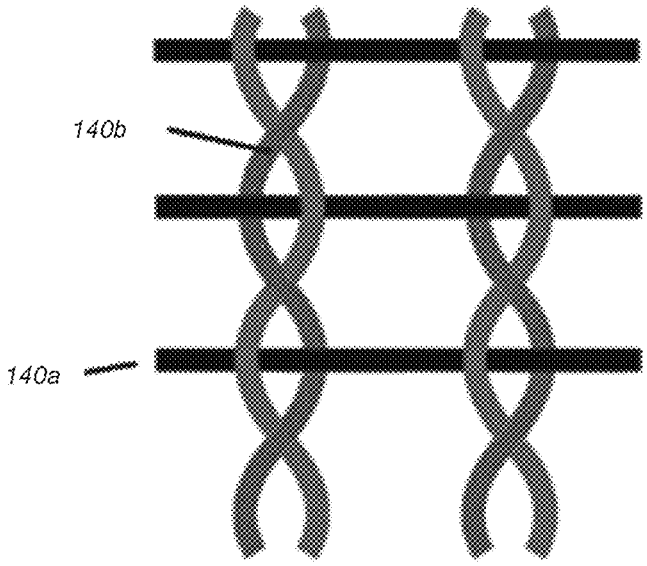

Meanwhile, FIG. 3 is a view illustrating a textile reinforcement material in the textile-reinforced concrete road paving apparatus according to the embodiment of the present invention, and FIG. 4 is a view illustrating the textile grid reinforcement material manufactured through a weaving method.

Recently, as shown in FIG. 3, a high strength fiber, such as carbon fiber, aramid fiber, and the like, is woven or knitted into lattice-shaped fabric so that a textile grid is manufactured, and the textile grid is impregnated with epoxy, vinyl ester, styrene-butadiene rubber (SBR) resin, and the like, and thus the textile grid reinforcement material 140 is manufactured. Since the textile grid reinforcement material uses a higher strength fiber than a plastic grid reinforcement material, the textile grid reinforcement material has high tensile strength and low tensile strain, and thus textile grid reinforcement material has excellent structural material properties for building and reinforcing structures.

As shown in a) of FIG. 4 and b) of FIG. 4, the textile grid reinforcement material 140 includes wefts 140*a* and warps 140*b*, and each of the weft 140*a* and the warp 140*b* is impregnated with a fiber bundle 141 and a resin 142, but the completed textile grid reinforcement material 140 is flexible enough to be wound in a roll form. Therefore, as described below, the textile grid reinforcement material 140 may be wound around a textile reinforcement material winding roll 310 and continuously disposed.

As shown in b) of FIG. 4, since the textile grid reinforcement material manufactured through the weaving method is woven by twisting the warps 140*b*, elongation in the direction of the warp 140*b* is greater than that in the direction of the weft 140*a* which is disposed linearly in a main direction.

Figure 5:
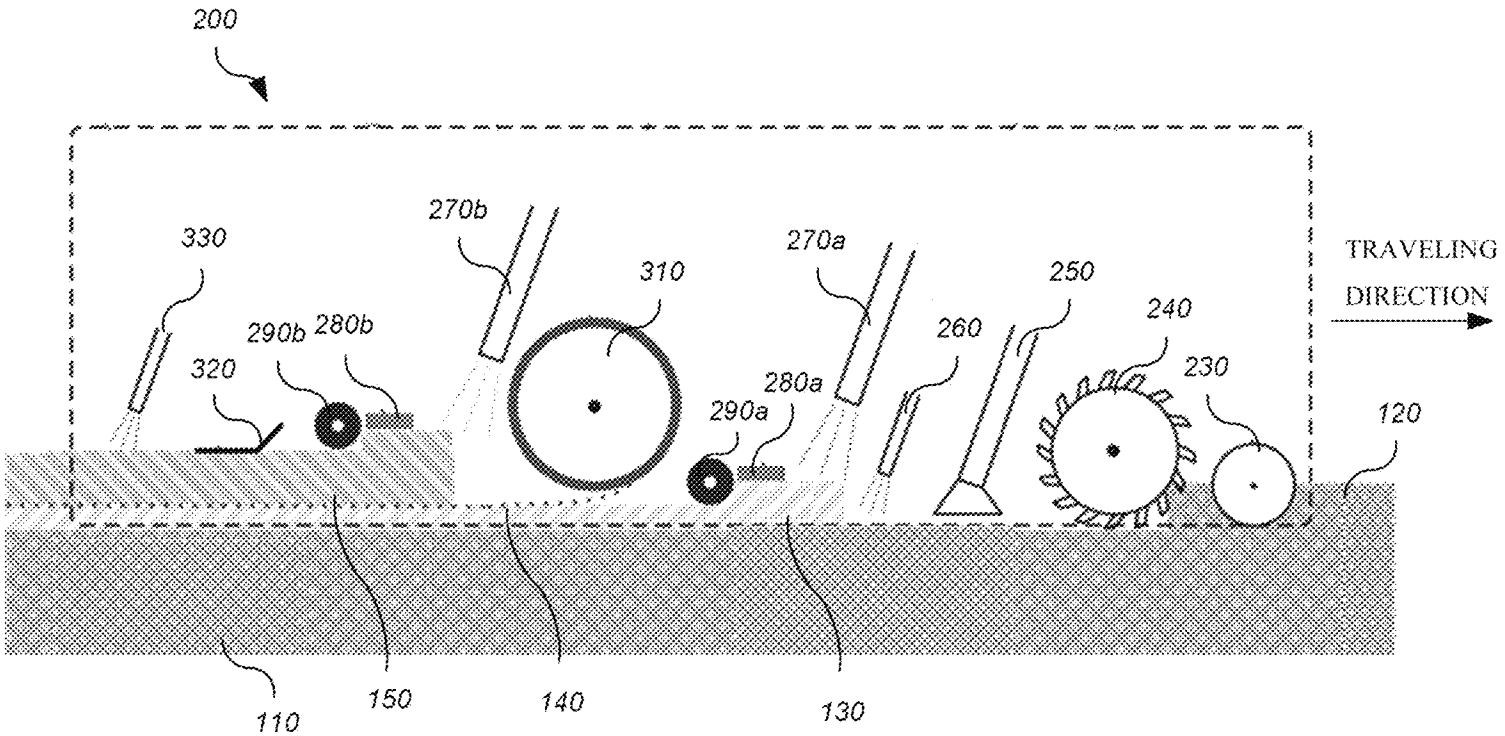
FIG. 5 is a schematic configuration view of the textile-reinforced concrete road paving apparatus according to the embodiment of the present invention.

Meanwhile, FIG. 5 is a schematic configuration view of the textile-reinforced concrete road paving apparatus according to the embodiment of the present invention.

Referring to FIG. 5, the textile-reinforced concrete road paving apparatus 200 according to the embodiment of the present invention includes a damaged cross section removing unit, a primary concrete paving and flattening unit, a first vibration press machine 290*a*, a textile reinforcement winding roll 310, a secondary concrete paving and flattening unit, a second vibration press machine 290*b*, and a damaged cross section finishing unit.

The damaged cross section removing unit cuts out and removes a damaged cross section 120 of concrete road pavement below a front part of the moving working vehicle 210. In this case, the damaged cross section removing unit includes circular grinders 230, a coal miner-type cutting machine 240, a vacuum suction device 250, and a water spraying device 260.

Specifically, the circular grinders 230 are installed on both sides of the front part of the moving working vehicle 210 and form grooves in the damaged cross section 120 of the concrete road pavement. The coal miner-type cutting machine 240 cuts and removes the damaged cross section 120 of the concrete road pavement at a predetermined thickness. Further, the vacuum suction device 250 removes the concrete of the cut damaged cross section 120, and the water spraying device 260 sprays water to keep the repaired cross section moist before construction of the first repair layer 130.

The primary concrete paving and flattening unit performs paving with primary concrete using a primary concrete paving tube 270*a* and flattens the primary concrete using a first spreader 280*a*. In this case, the primary concrete paving and flattening unit includes the primary concrete paving tube 270*a* and the first spreader 280*a*.

Specifically, the primary concrete paving tube 270*a* performs paving with primary concrete for construction of the first repair layer 130, and the first spreader 280*a* moves in a direction perpendicular to the traveling direction of the road and evenly flattens the primary concrete.

The first vibration press machine 290*a* simultaneously compacts the primary concrete and constructs the first repair layer 130 of the repaired cross section to have a required thickness.

The textile reinforcement material 140 is wound on the textile reinforcement material winding roll 310, and the textile reinforcement material winding roll 310 continuously disposes the textile reinforcement material 140 on the repaired cross section.

The secondary concrete paving and flattening unit performs paving with the secondary concrete on the first repair layer 130 using the secondary concrete paving tube 270*b* and flattens the secondary concrete using the second spreader 280*b*. In this case, the secondary concrete paving and flattening unit includes the secondary concrete paving tube 270*b* and the second spreader 280*b*.

Specifically, the secondary concrete paving tube 270*b* performs paving with the secondary concrete for construction of the second repair layer 150, moves the second spreader 280*b* in a direction perpendicular to the traveling direction of the road, and evenly flattens the secondary concrete. In this case, the thicknesses of the poured primary and secondary concrete are precisely adjusted by the primary and secondary concrete paving tubes 270*a* and 270*b*.

The second vibration press machine 290*b* simultaneously compacts the secondary concrete and constructs the second repair layer 150 to have a required thickness.

The repaired cross section finishing unit finishes a repaired cross section, which includes the first repair layer 130, the textile reinforcement material 140, and the second repair layer 150, below a rear part of the moving working vehicle 210. In this case, the repaired cross section finishing unit includes a plastering knife 320 and a membrane curing solution spraying device 330.

Specifically, the plastering knife 320 moves in a direction perpendicular to the traveling direction of the road to finish the repaired cross section, and the membrane curing solution spraying device 330 sprays a membrane curing solution to start curing immediately after construction. In this case, since the service life of the concrete poured on the road depends on a curing period after the construction, hydration of the concrete during the curing period is facilitated. After concrete is poured, the membrane curing agent is finally sprayed by the coating curing liquid spraying device 330 to reduce shrinkage cracks in concrete caused by water evaporation so as to form a film on a surface of the concrete.

Therefore, the textile-reinforced concrete road paving apparatus 200 according to the embodiment of the present invention may collectively and consecutively perform processes of cutting concrete, disposing a reinforcement material, and constructing the repaired cross section.

More specifically, referring to FIG. 5, the textile-reinforced concrete road paving apparatus 200 according to the embodiment of the present invention may be applied to concrete slab covering construction of a road, an airport, a harbor and the like, but concrete pavement covering of a national expressway which is 3.6 m in width will be described. Therefore, a paving width of the textile-reinforced concrete road paving apparatus 200 according to the embodiment of the present invention may be set to 1.0 to 3.6 m.

The coal miner-type cutting machine 240 generally cuts the concrete to within 5 cm once to enable the discharge of the remainder through vacuum suction, and two cutting machines may be serially installed to cut the concrete of 10 cm. In this case, the cut concrete is transferred to the outside of the moving working vehicle 210 using the vacuum suction device 250. Further, the water spraying device 260 sprays a previously calculated spray amount of water to perform moisture treatment on the repaired cross section, and thus the repair concrete to be newly poured is well attached to existing concrete. In this case, the water spraying tube of the water spraying device 260 may be spaced apart from the primary concrete paving tube 270*a* so that the sprayed water sufficiently permeates the cross section.

After this, the concrete automatically poured through the primary concrete paving tube 270*a* is finished by the first spreader 280*a* so that the first repair layer 130 is formed. In this case, the primary concrete poured to form the first repair layer 130 is poured and compacted to have a required thickness by the first vibration press machine 290*a*. In this case, the first and second vibration press machines 290*a* and 290*b* have a tubular steel pipe, are self-propelled to rotate, and have vibrators embedded therein to provide vibration and pressure to the concrete so as to firmly compact the concrete.

After this, the textile grid reinforcement material 140 wound around the textile reinforcement material winding roll 310 is automatically disposed on an upper surface of the compacted first repair layer 130. In this case, the primary concrete paving tube 270*a*, the first spreader 280*a*, the first vibration press machine 290*a*, and the textile reinforcement material winding roll 310 may be further provided so that the above-described processes are repeated to form pavement with the textile grid reinforcement material 140 in a multi-layer manner. That is, construction of the first repair layer 130 and disposition of the textile grid reinforcement material 140 are repeated.

After this, after the textile grid reinforcement material 140 is disposed, the second repair layer 150 is formed in the same process as the first repair layer 130. In this case, for precise construction, movement of the moving working vehicle 210, cutting out of concrete, paving of the first and second repair layers 130 and 150, paving of the textile grid reinforcement material 140, and operation of the first and second vibration press machine 130 and 150 may be controlled by a computer. Further, in the moving working vehicle 210, the heights of the first and second vibration press machines 290*a* and 290*b*, the textile reinforcement material winding roll 310, and the plastering knife 320 may be adjusted by a computer to form a required thickness.

Figure 6:
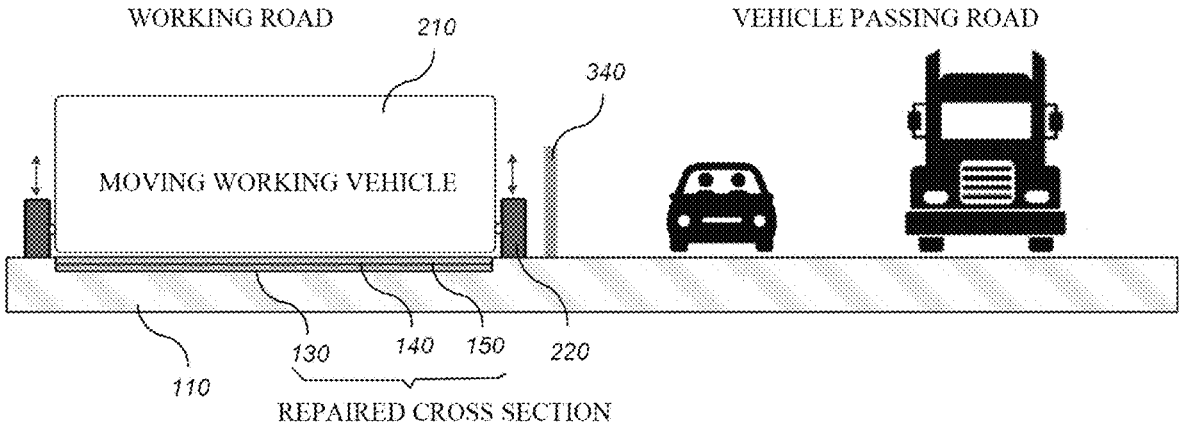
FIG. 6 is a front view illustrating the textile-reinforced concrete road paving apparatus according to the embodiment of the present invention disposed on a road.

Meanwhile, FIG. 6 is a front view illustrating the textile-reinforced concrete road paving apparatus according to the embodiment of the present invention disposed on the road.

Referring to FIG. 6, a construction method using the textile-reinforced concrete road paving apparatus according to the embodiment of the present invention will be described below in a state in which traffic is partially blocked.

When the textile-reinforced concrete road paving apparatus 200 is used, after a working fence 340 is installed, construction is performed on a repaired cross section while traffic is partially blocked. For example, in a two-lane roadway, repair is performed by the textile-reinforced concrete road paving apparatus 200 on a working road, which is a first lane, and vehicles pass on a vehicle passing road, which is a second lane, and thus the repair can be performed without construction of a detour or blocking of traffic.

Further, a concrete slab 110 is formed by paving, compacting, and curing the primary and secondary concrete, joints may be formed on the concrete slab 110 at regular distances of about 6 to 10 m to correspond to contraction due to temperature.

Figure 7:
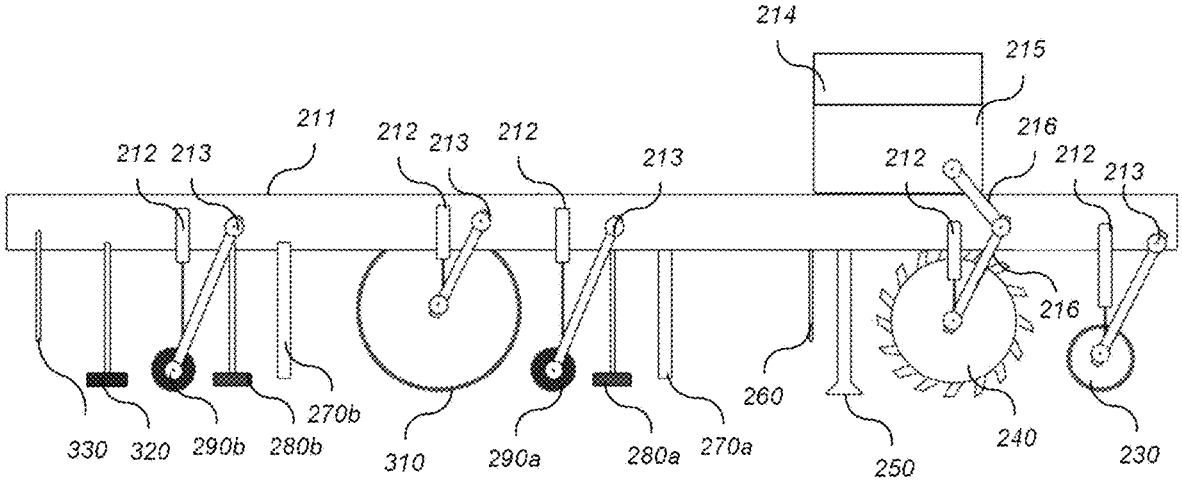
FIG. 7 is a side view of the textile-reinforced concrete road paving apparatus according to the embodiment of the present invention.
Figure 8:
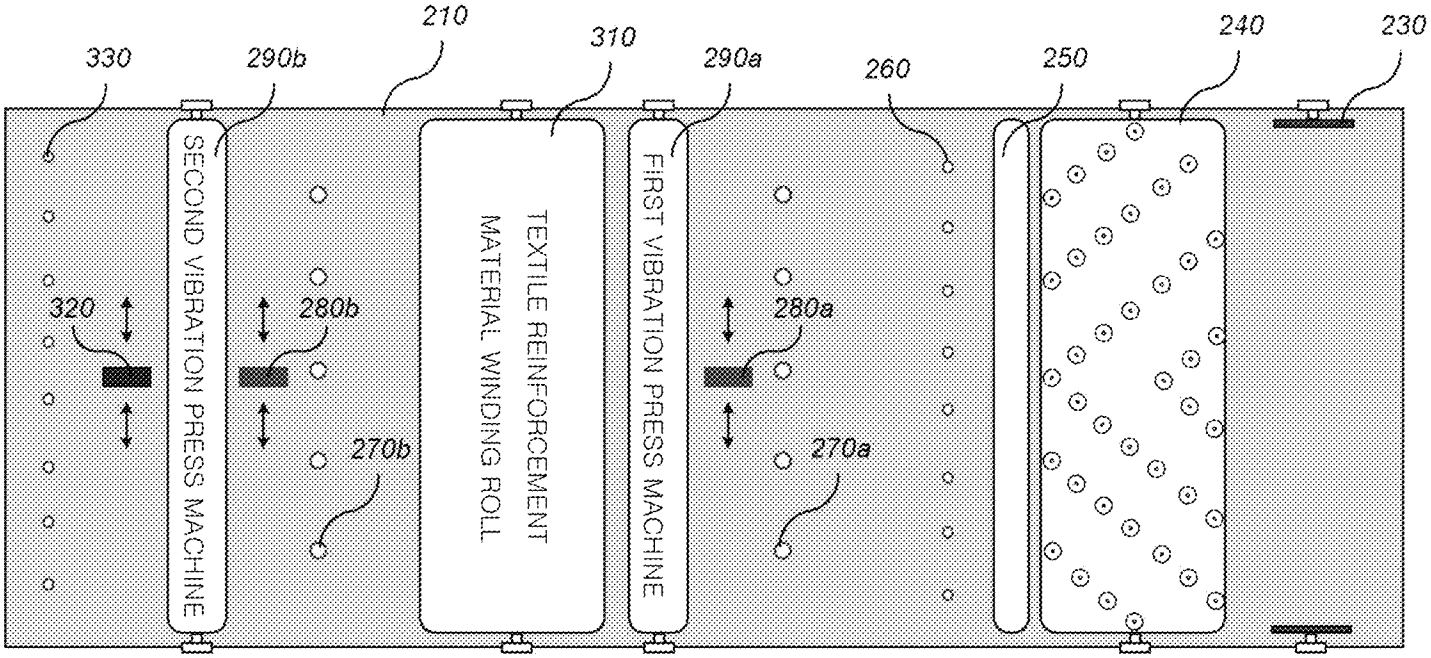
FIG. 8 is a rear view of the textile-reinforced concrete road paving apparatus according to the embodiment of the present invention.

Meanwhile, FIG. 7 is a side view of the textile-reinforced concrete road paving apparatus according to the embodiment of the present invention, and FIG. 8 is a rear view of the textile-reinforced concrete road paving apparatus according to the embodiment of the present invention.

As shown in FIGS. 7 and 8, the textile-reinforced concrete road paving apparatus 200 according to the embodiment of the present invention includes the circular grinders 230, the coal miner-type cutting machine 240, the vacuum suction device 250, the water spraying device 260, the primary concrete paving tube 270*a*, the first spreader 280*a*, the first vibration press machine 290*a*, the textile reinforcement material winding roll 310, the secondary concrete paving tube 270*b*, the second spreader 280*b*, the second vibration press machine 290*b*, the plastering knife 320, and the membrane curing solution spraying device 330 that are sequentially installed on a lower portion of the moving working vehicle 210 in a traveling direction.

Further, in the textile-reinforced concrete road paving apparatus 200 according to the embodiment of the present invention, a chassis 211, actuators 212, a pulley 213, an engine 214, a gearbox 215, and a driving belt 216 may be mounted in the moving working vehicle 210.

Specifically, in the case of the moving working vehicle 210, the above-described devices are formed on the chassis 211 with a rectangular cross section, each of the devices is connected with a driving shaft and the driving belt 216 through a movable device, and the hydraulic actuators 212 controlled by a sensor and a computer are mounted to adjust a height of the moving working vehicle 210 and applied pressure. In this case, the first and second spreaders 280*a* and 280*b* and the plastering knife 320 are operated in a direction perpendicular to a traveling direction of the moving working vehicle 210.

Figure 9:
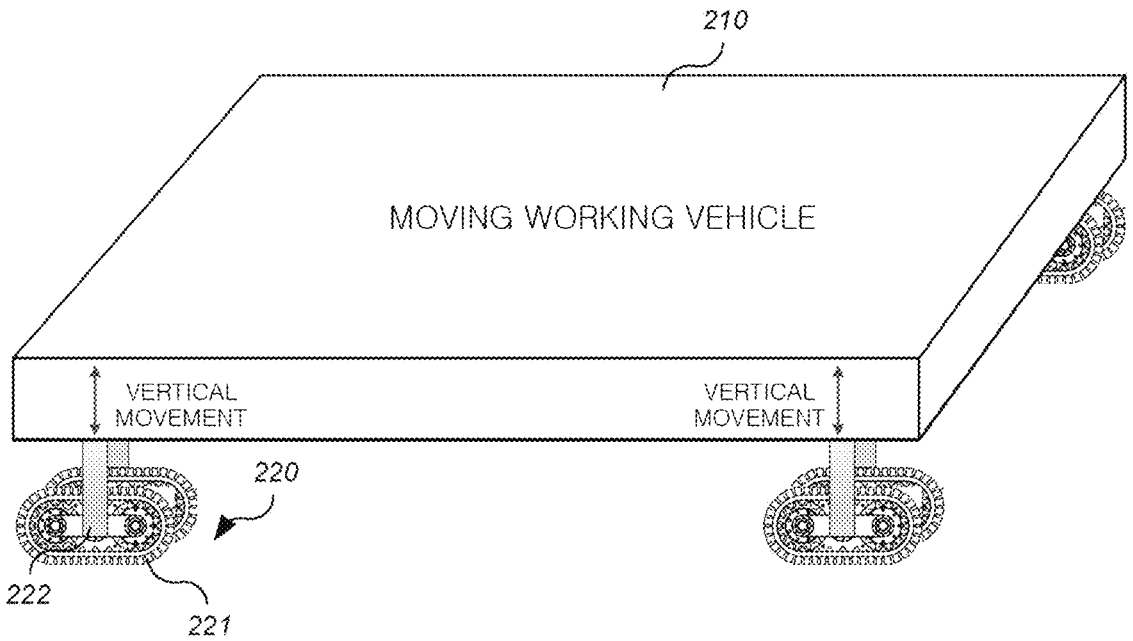
FIG. 9 shows a perspective view and a plan view illustrating a moving working vehicle and continuous tracks in the textile-reinforced concrete road paving apparatus according to the embodiment of the present invention.
Figure 9:
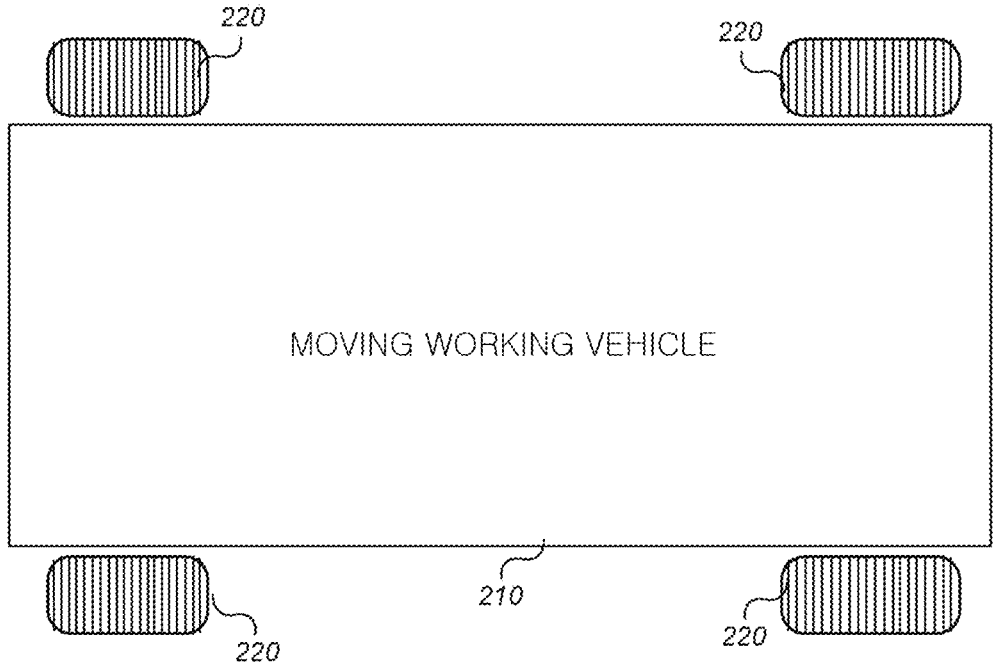
Figure 10:
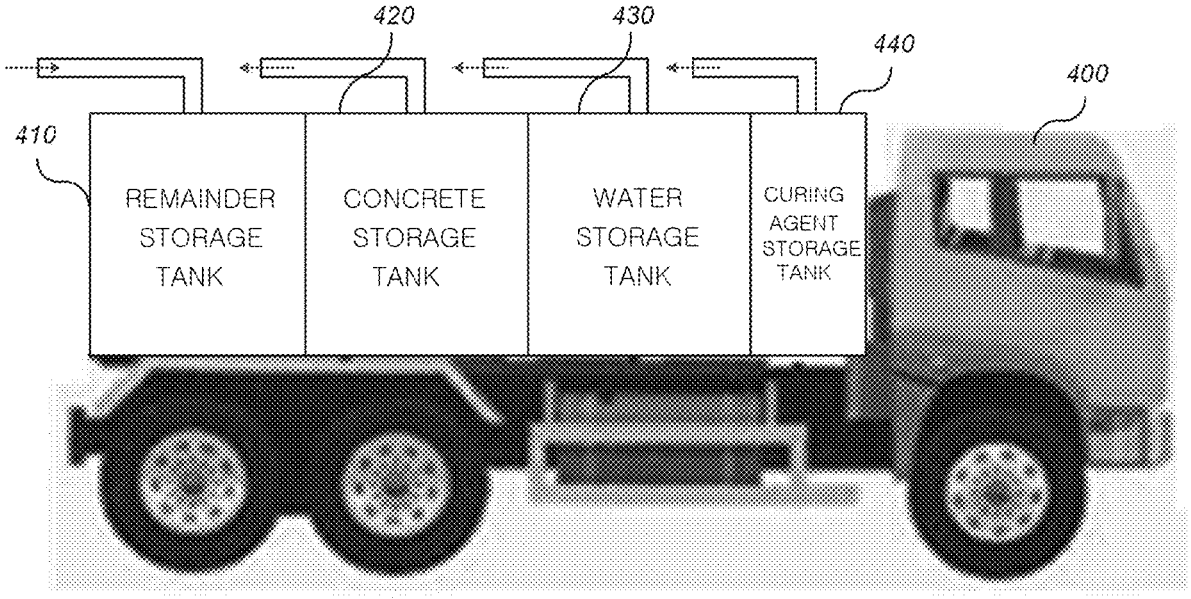
FIG. 10 is a view illustrating a material/remainder carrying vehicle and the textile-reinforced concrete road paving apparatus according to the embodiment of the present invention.

Meanwhile, FIG. 9 shows a perspective view and a plan view illustrating the moving working vehicle and the continuous tracks in the textile-reinforced concrete road paving apparatus according to the embodiment of the present invention, and FIG. 10 is a view illustrating the material/remainder transferring vehicle and the textile-reinforced concrete road paving apparatus according to the embodiment of the present invention.

As shown in FIG. 9, the textile-reinforced concrete road paving apparatus 200 according to the embodiment of the present invention self-propels forward using the continuous tracks 220, and the continuous tracks 220 are mounted on four edges of the moving working vehicle 210. That is, since a lower space of the moving working vehicle 210 is a working space, the continuous track 220 may be mounted on the four edges of the moving working vehicle 210. Further, the continuous tracks 220 may allow a height of the moving working vehicle 210 to be adjusted by vertical movement of a height adjustment device 223.

Further, as shown in FIG. 10, a material/remainder transferring vehicle 400 may be disposed in front of the moving textile-reinforced concrete road paving apparatus 200 as a preceding working vehicle, wherein the material/remainder transferring vehicle 400 includes a material loading box, a mobile mixer, a transfer tube and the like.

Specifically, the material/remainder transferring vehicle 400 includes a remaining storage tank 410, a concrete storage tank 420, a water storage tank 430, and a curing agent storage tank 440, may load remainder, which is wasted concrete, may supply a material required for concrete paving, such as concrete, water, a curing agent, and may be moved with the textile-reinforced concrete road paving apparatus 200.

Therefore, the textile-reinforced concrete road paving apparatus according to the embodiment of the present invention is a concrete paving and repairing apparatus that selectively and thinly removes only a damaged cross section and selectively paves the repaired cross section with concrete and a reinforcement material. The textile-reinforced concrete road paving apparatus removes a damaged cross section, performs paving with concrete, and cures the concrete in a consecutive manner as a movable vehicle, thereby minimizing blocking of traffic and remarkably reducing a construction period when compared with a conventional full replacement method.

Figure 11:
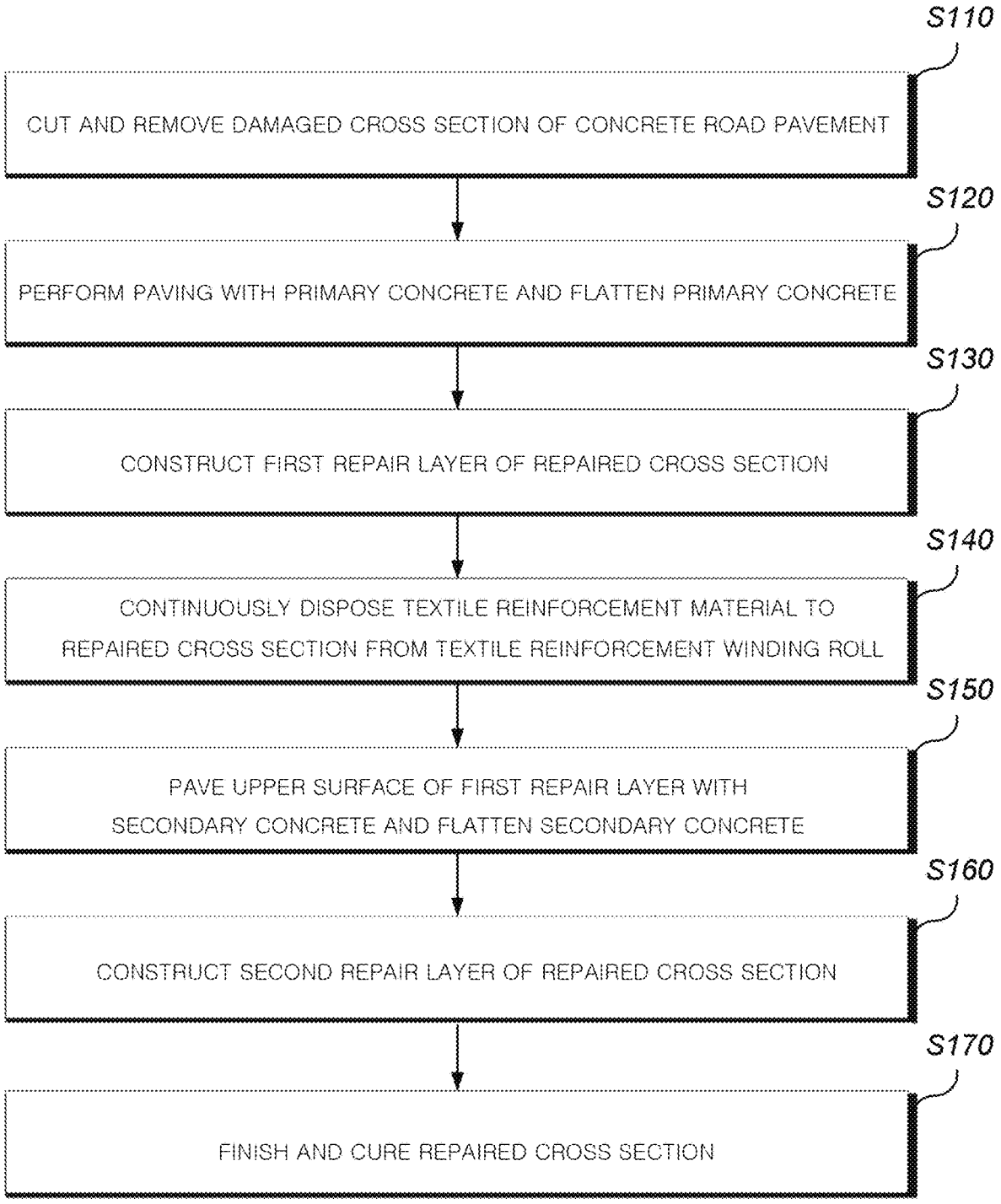
FIG. 11 is a schematic flowchart of a method of repairing concrete road pavement using the textile-reinforced concrete road paving apparatus according to the embodiment of the present invention.
Figure 12:
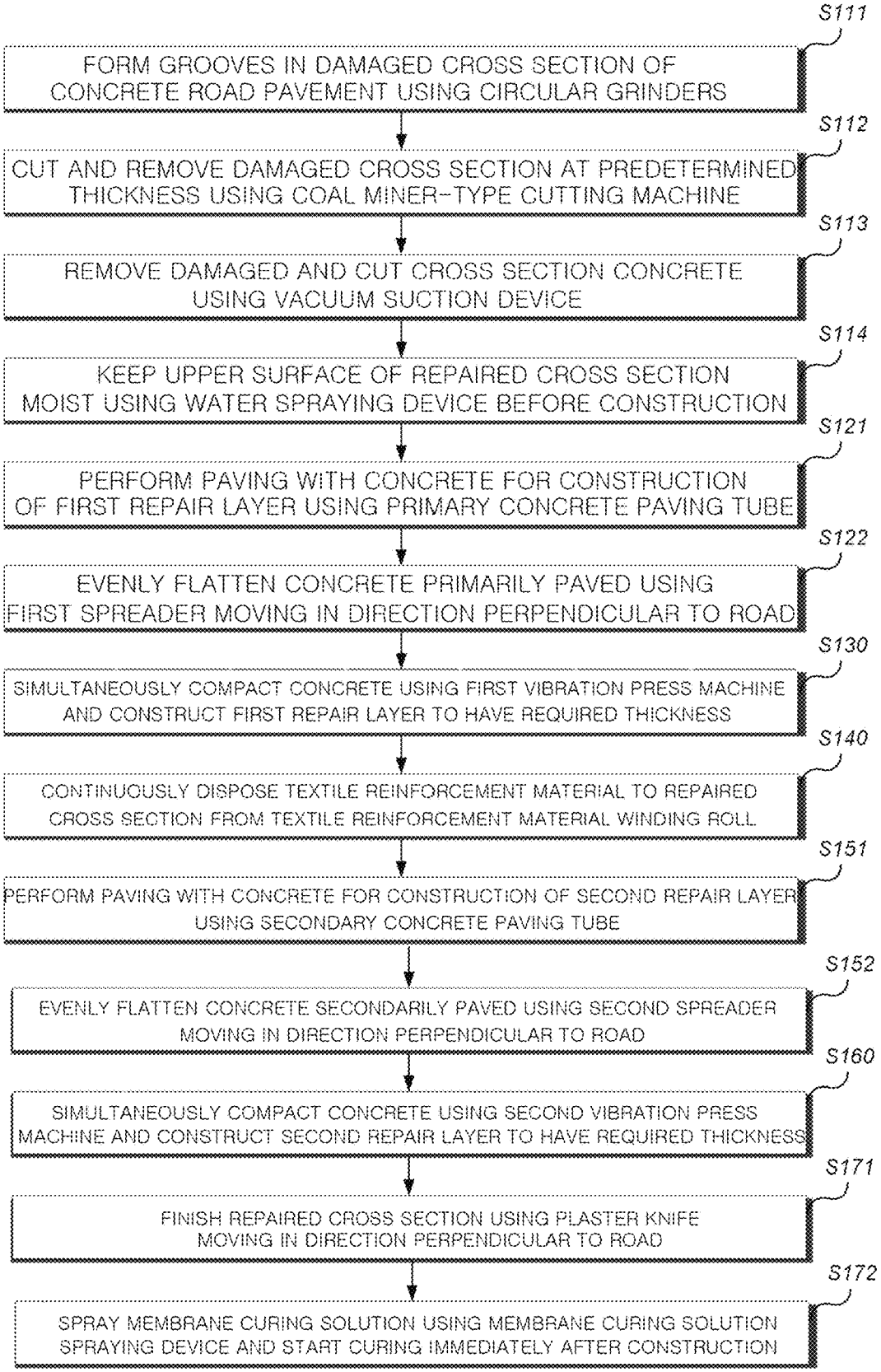
FIG. 12 is a detailed flowchart of the method of repairing concrete road pavement shown in FIG. 11.

Method of Repairing Concrete Road Pavement Using Textile-Reinforced Concrete Road Paving Apparatus FIG. 11 is a schematic flowchart of a method of repairing concrete road pavement using the textile-reinforced concrete road paving apparatus according to the embodiment of the present invention, and FIG. 12 is a detailed flowchart of the method of repairing concrete road pavement shown in FIG. 11.

Referring to FIGS. 11 and 12, the method of repairing concrete road pavement using the textile-reinforced concrete road paving apparatus according to the embodiment of the present invention, which is a method of repairing concrete road pavement using the textile-reinforced concrete road paving apparatus 200, is as follows. First, a damaged cross section 120 of concrete road pavement is cut and removed below a moving working vehicle 210 by the textile-reinforced concrete road paving apparatus 200 (S110).

Specifically, as shown in FIG. 12, grooves are formed in the damaged cross section 120 of the concrete road pavement by circular grinders 230 (S111), the damaged cross section 120 is cut and removed at a predetermined thickness by a coal miner-type cutting machine 240 (S112), the cut concrete of the damaged cross section 120 is removed by a vacuum suction device 250 (S113), and an upper surface of the repaired cross section before construction of the first repair layer 130 is maintained moist by the water spraying device 260 (S114).

Next, primary concrete is poured by a primary concrete paving tube 270*a* and flattened by a first spreader 280*a* (S120). Specifically, as shown in FIG. 12, the primary concrete for construction of the first repair layer 130 is poured by the primary concrete paving tube 270*a* (S121), and the primary concrete is evenly flattened by the first spreader 280*a* in a direction perpendicular to a traveling direction of a road (S122).

Next, the primary concrete is compacted by the first vibration press machine 290*a*, and the first repair layer 130 of the repaired cross section is simultaneously constructed to have a required thickness (S130).

Next, the textile reinforcement material 140 is continuously disposed to the repaired cross section from the textile reinforcement material winding roll 310 (S140).

Next, secondary concrete is poured on the first repair layer 130 by the secondary concrete paving tube 270*b* and is flattened by the second spreader 280*b* (S150). Specifically, as shown in FIG. 12, the secondary concrete for construction of the second repair layer 150 is poured through the secondary concrete paving tube 270*b* (S151), and the poured secondary concrete is evenly flattened by the second spreader 280*b* that moves in the direction perpendicular to the traveling direction of the road (S152).

Next, the secondary concrete is compacted by the second vibration press machine 290*b*, and the second repair layer 150 is constructed to have a required thickness (S160).

Next, the repaired cross section that includes the first repair layer 130, the textile reinforcement material 140, and the second repair layer 150 is constructed and immediately cured below a rear part of the moving working vehicle 210 (S170). Specifically, as shown in FIG. 12, the repaired cross section is finished by a plastering knife 320 moving in the direction perpendicular to the traveling direction of the road (S171), a membrane curing solution is sprayed by a membrane curing solution spraying device 330 (S172), and curing starts immediately after the construction.

Therefore, in the method of repairing concrete road pavement using the textile-reinforced concrete road paving apparatus according to the embodiment of the present invention, the textile-reinforced concrete road paving apparatus 200 may consecutively and selectively perform cut of the concrete, disposition of the reinforcement material, and finishing of the repaired cross section.

Therefore, according to the embodiment of the present invention, by using the textile-reinforced concrete road paving apparatus integrally formed to consecutively cut concrete, dispose a reinforcement material, and finish a repaired cross section, use of construction equipment is minimized so that a construction period is reduced, and thus construction costs are remarkably reduced. Further, a textile grid reinforcement material, which is a noncorroding reinforcement material, is applied to form the repaired cross section of the concrete road pavement so as to prevent concrete from being detached due to corrosion. Further, the textile reinforcement grid can be precisely disposed at a required position, and the pouring thicknesses of the primary and secondary concrete are precisely adjusted, and thus construction precision can be increased.

The above description is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims, and encompasses all modifications or alterations derived from meanings, the scope, and equivalents of the appended claims.

What is claimed is:

1. A textile-reinforced concrete road paving apparatus, comprising:

a damaged cross section removing unit configured to cut and remove a damaged cross section of concrete road pavement below a front part of a moving working vehicle;

a primary concrete paving and flattening unit configured to perform paving with primary concrete using a primary concrete paving tube and a first spreader and flattening the primary concrete;

a first vibration press machine configured to simultaneously compact the primary concrete and construct a first repair layer of a repaired cross section to have a required thickness;

a textile reinforcement material winding roll on which a textile reinforcement material, which is a noncorroding reinforcement material, is wound and which continuously disposes the textile reinforcement material on the repaired cross section;

a secondary concrete paving and flattening unit configured to pave an upper portion of the first repair layer with secondary concrete using a secondary concrete paving tube and a second spreader and flatten the secondary concrete;

a second vibration press machine configured to simultaneously compact the secondary concrete and construct a second repair layer to have a required thickness; and a repaired cross section finishing unit configured to finish and cure the repaired cross section below a rear part of the moving working vehicle, wherein the repaired cross section comprises the first repair layer, the textile reinforcement material, and the second repair layer, and the textile-reinforced concrete road paving apparatus is configured to consecutively and collectively cut concrete, dispose a reinforcement material, and construct a repaired cross section.

2. The textile-reinforced concrete road paving apparatus of claim 1, wherein the secondary concrete paving and flattening unit comprises:

the secondary concrete paving tube that performs paving with the secondary concrete for the construction of the second repair layer; and the second spreader that moves in a direction perpendicular to a traveling direction of a road and evenly flattens the paved secondary concrete.

3. The textile-reinforced concrete road paving apparatus of claim 1, wherein the repaired cross section finishing unit comprises:

a plastering knife that moves in a direction perpendicular to a traveling direction of a road and finishes the repaired cross section; and a membrane curing solution spraying device that sprays a membrane curing solution so that curing starts immediately after the construction of the repaired cross section.

4. The textile-reinforced concrete road paving apparatus of claim 1, wherein the damaged cross section removing unit comprises:

circular grinders that are mounted on both sides of the front part of the moving working vehicle and form grooves in the damaged cross section of the concrete road pavement;

a coal miner-type cutting machine that cuts out and removes the damaged cross section of the concrete road pavement at a predetermined thickness;

a vacuum suction device that removes concrete of the damaged and cut cross section; and a water spraying device that sprays water to keep an upper surface of the repaired cross section moist before the construction of the first repair layer.

5. The textile-reinforced concrete road paving apparatus of claim 4, wherein the coal miner-type cutting machine cuts out the damaged cross section to within 5 cm once so that remainder is discharged through vacuum suction.

6. The textile-reinforced concrete road paving apparatus of claim 4, wherein the primary concrete paving and flattening unit comprises:

the primary concrete paving tube that performs paving with the primary concrete for the construction of the first repair layer; and the first spreader that moves in a direction perpendicular to a traveling direction of a road and evenly flattens the paved primary concrete.

7. The textile-reinforced concrete road paving apparatus of claim 6, wherein a water spraying tube of the water spraying device is spaced apart from the primary concrete paving tube so that the sprayed water sufficiently permeates the repaired cross section.

8. The textile-reinforced concrete road paving apparatus of claim 1, wherein the moving working vehicle is self-propelled forward by continuous tracks, wherein the continuous tracks are mounted on four edges of the moving working vehicle and comprise height adjustment devices that adjust a height of the moving working vehicle through vertical movement.

9. The textile-reinforced concrete road paving apparatus of claim 8, wherein, in the moving working vehicle, heights of the first vibration press machine and the second vibration press machine, the textile reinforcement material winding roll, and a plastering knife is adjusted by a computer so that a required thickness is formed.

10. The textile-reinforced concrete road paving apparatus of claim 9, wherein the moving working vehicle comprises a hydraulic actuator that is controlled by a sensor and a computer to adjust the height of the moving working vehicle and applied pressure.

11. A method of repairing concrete road pavement using a textile-reinforced concrete road paving apparatus, wherein the method comprises the following operations:

a) cutting out and removing a damaged cross section of concrete pavement below a front part of a moving working vehicle using the textile-reinforced concrete road paving apparatus;

b) performing paving with primary concrete using a primary concrete paving tube and a first spreader and flattening the primary concrete;

c) simultaneously compacting the primary concrete using a first vibration press and constructing a first repair layer of a repaired cross section to have a required thickness;

d) continuously disposing a textile reinforcement material to the repaired cross section from a textile reinforcement material winding roll;

e) performing paving with secondary concrete on the first repair layer using a secondary concrete paving tube and a second spreader and flattening the secondary concrete;

f) simultaneously compacting the secondary concrete using a second vibration press machine and constructing a second repair layer to have a required thickness; and g) finishing the repaired cross section and immediately curing the repaired cross section below a rear part of the moving working vehicle, wherein the repaired cross section comprises the first repair layer, the textile reinforcement material, and the second repair layer, wherein the textile-reinforced concrete road paving apparatus collectively and consecutively cuts out concrete, disposes a reinforcement material, and finishes a repaired cross section.

12. The method of claim 11, wherein the operation a) comprises:

a-1) forming grooves in the damaged cross section using circular grinders;

a-2) cutting and removing the damaged cross section at a predetermined thickness using a coal miner-type cutting machine;

a-3) removing concrete of the damaged and cut cross section using a vacuum suction device; and a-4) keeping an upper surface of the repaired cross section moist using a water spraying device before the construction of the first repair layer.

13. The method of claim 11, wherein the operation b) comprises:

b-1) performing paving with the primary concrete for the construction of the first repair layer using the primary concrete paving tube; and b-2) evenly flattening the paved primary concrete using the first spreader that moves in a direction perpendicular to a traveling direction of a road.

14. The method of claim 11, wherein the operation e) comprises:

e-1) performing paving with the secondary concrete for the construction of the second repair layer using the secondary concrete paving tube; and e-2) evenly flattening the paved secondary concrete using the second spreader that moves in a direction perpendicular to a traveling direction of a road.

15. The method of claim 11, wherein the operation g) comprises:

g-1) finishing the repaired cross section using a plastering knife that moves in a direction perpendicular to a traveling direction of a road; and g-2) spraying a membrane curing solution using a membrane curing solution spraying device to start curing immediately after the construction of the second repair layer.

16. The method of claim 11, wherein joints are formed on a paved, compacted, and cured concrete slab of the primary concrete and the secondary concrete at regular distances of 6 to 10 m to correspond to shrinkage due to temperature.

17. The method of claim 11, wherein the moving working vehicle in the operation a) is self-propelled forward by continuous tracks, and the continuous tracks are mounted on four edges of the moving working vehicle, and a height adjusting device is formed to adjust a height of the moving working vehicle through vertical movement.

18. The method of claim 17, wherein, in the moving working vehicle, heights of the first vibration press machine and the second vibration press machine, the textile reinforcement material winding roll, and a plastering knife are adjusted by a computer to form a required thickness.

19. A concrete road pavement repaired by the method of repairing concrete road pavement using a textile-reinforced concrete road paving apparatus according to claim 11.

* * * * *